US006836212B2

(12) United States Patent
Sawinski

(10) Patent No.: US 6,836,212 B2
(45) Date of Patent: Dec. 28, 2004

(54) METHOD AND APPARATUS FOR REDUCING THE LIKELIHOOD OF LOSING A PORTABLE ELECTRONIC DEVICE

(75) Inventor: John P. Sawinski, Flower Mound, TX (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/268,230

(22) Filed: Oct. 10, 2002

(65) Prior Publication Data

US 2004/0070499 A1 Apr. 15, 2004

(51) Int. Cl.[7] ..... G08B 1/08

(52) U.S. Cl. ..... 340/539.23; 340/539.32; 340/561; 340/562; 340/568.1; 340/573.1; 200/600; 341/33

(58) Field of Search ..... 340/539.23, 546, 340/545.4, 551, 552, 562, 563, 561, 568.6, 568.7, 572.1, 568.1, 539.1, 539.32, 573.1; 455/574, 575.1, 348, 346, 438, 351; 224/245, 197; 200/600; 341/33

(56) References Cited

U.S. PATENT DOCUMENTS 5,952,835 A * 9/1999 Coveley ..... 324/252
5,959,533 A * 9/1999 Layson, Jr. et al. ..... 340/573.1
5,987,609 A 11/1999 Hasebe
6,154,665 A * 11/2000 Briffett ..... 455/574
6,310,955 B1 * 10/2001 Reeves ..... 379/424
6,559,767 B2 * 5/2003 Huang ..... 340/568.1
6,674,358 B1 * 1/2004 Tinsley ..... 340/7.63

* cited by examiner

*Primary Examiner*—Davetta W. Goins
(74) *Attorney, Agent, or Firm*—Daniel C. Crilly; Sylvia Chen

(57) ABSTRACT

A loss prevention system (e.g., 200) employs a method and apparatus for reducing the likelihood of losing a portable electronic device (100, 201) that has been inadvertently removed from its retaining device (e.g., 203, 300, 400). The loss prevention system includes the electronic device and its retaining device. The electronic device includes a proximity detector (103) that operates to detect the absence or removal of the device from the retaining device. The electronic device further includes a lost device detection circuit (102) that determines whether the removal was intentional and, if unintentional, alerts the user of the removal. By so alerting the user, the loss prevention system provides rapid feedback to the user after the user's electronic device has inadvertently fallen out of its retaining device, thereby enabling the user to quickly retrieve the device before it gets damaged or taken by someone else.

14 Claims, 4 Drawing Sheets

300

400

METHOD AND APPARATUS FOR REDUCING THE LIKELIHOOD OF LOSING A PORTABLE ELECTRONIC DEVICE

FIELD OF THE INVENTION

The present invention relates generally to portable electronic devices and, in particular, to reducing the likelihood of permanently losing a portable electronic device in the event that the device is inadvertently removed from a retaining device, such as a holster or a belt clip.

BACKGROUND OF THE INVENTION

Portable electronic devices are well known. Such devices include cellular telephones, personal digital assistants (PDAs), wireless email devices, instant messaging devices, pagers, portable compact disk (CD) players, and portable MP3 players, just to name a few. Many of these electronic devices are oftentimes secured to their users or their users' personal effects by inserting the device or an applicable part thereof into a retaining device, such as a holster, carrying case or belt clip, and then clamping or otherwise attaching the retaining device to the user's personal effects (e.g., belt, pant's pocket, purse, or carrying bag).

For various reasons, such as improper insertion of the device in the retaining device, contact or pressure upon the electronic device while secured in the retaining device, or defects in the retaining device itself, a portable electronic device may be inadvertently removed from its retaining device. Depending upon the circumstances under which the electronic device is so removed, the user may not realize that such removal even occurred. In such circumstances, the device is then lost, and the user must go through the frustrating task of obtaining a new device, not to mention potentially being out-of-pocket hundreds of dollars depending upon the type of device that was lost and whether or not the device was insured against such loss. In addition, if a service is affected (e.g., a phone, paging or email service), the user of the lost device must contact his or her service provider to alert it of the missing device.

Existing wireless device loss detection approaches focus primarily on remotely programming the lost device to (i) prohibit the device from performing certain operations, such as prohibiting the placement of phone calls, and/or (ii) instruct the device to perform certain operations, such as displaying device owner information or erasing certain data stored in the device, in an attempt to increase the user's chances of recovering the device or protecting data stored in the device. However, no existing loss detection approaches provide a mechanism for quickly alerting a user in the event that the user's electronic device is inadvertently separated from its retaining device, thereby serving to prevent the loss in the first place or at least increasing the likelihood of retrieving the lost device.

Therefore, a need exists for a method and apparatus for reducing the likelihood of losing a portable electronic device that has been inadvertently removed from its retaining device, wherein such method and apparatus alert the user of such inadvertent removal in sufficient time for the user to take prompt action to retrieve the device.

DETAILED DESCRIPTION OF A PREFERRED EMBODIMENT

Generally, the present invention encompasses a method and apparatus for reducing the likelihood of losing a portable electronic device that has been inadvertently removed from its retaining device. The electronic device includes a proximity detector that operates to detect the absence or removal of the device from the retaining device. The electronic device further includes a lost device detection circuit (preferably implemented as logic circuitry and software executed by a processor) that determines whether the removal was intentional and, if unintentional, alerts the user of the removal. By so alerting the user, the present invention provides rapid feedback to the user after the user's electronic device has inadvertently fallen out of its retaining device, thereby enabling the user to quickly retrieve the device before it gets damaged or taken by someone else.

Figure 1:
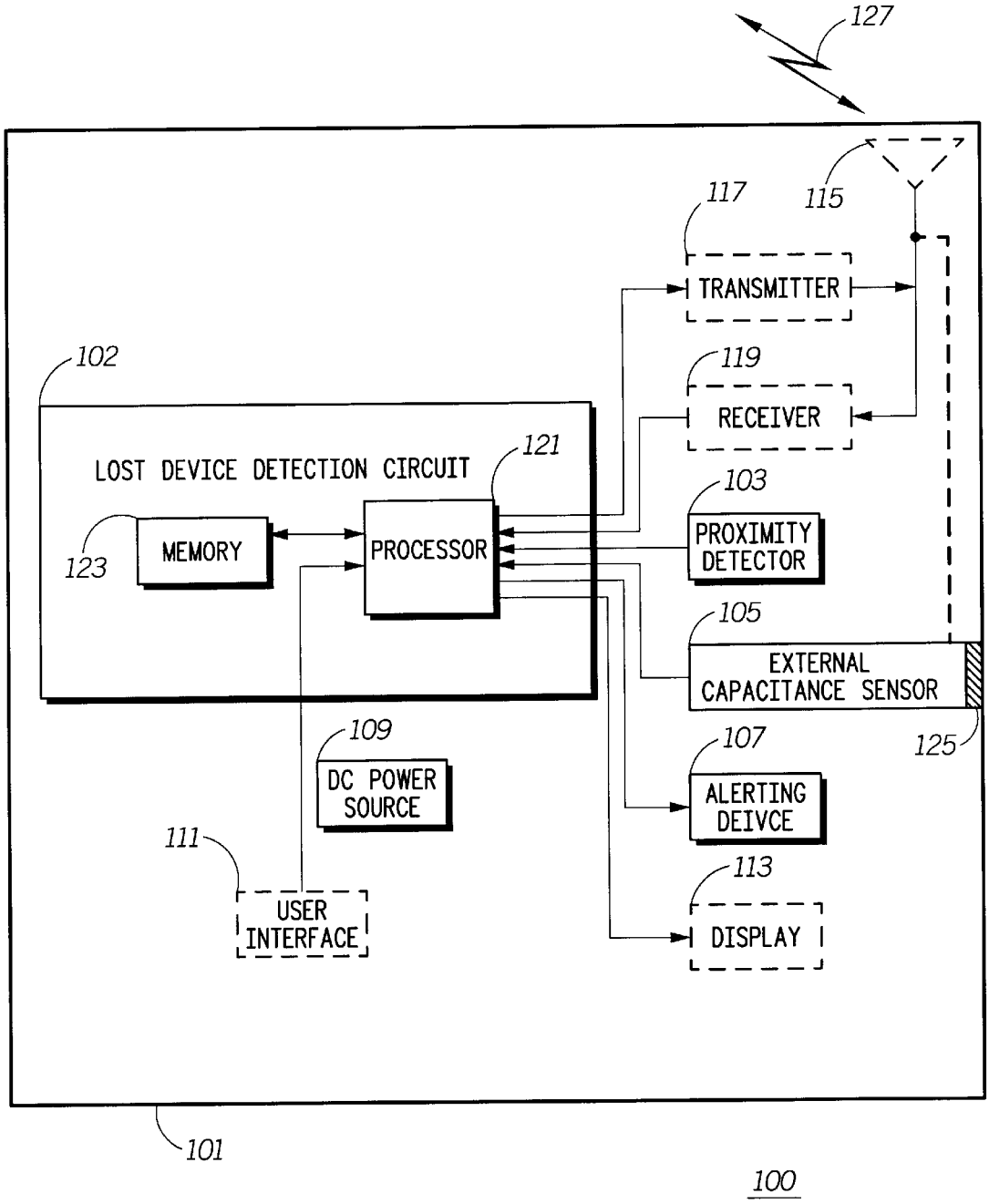
FIG. 1 is an electrical block diagram of an exemplary portable electronic device in accordance with the present invention.

The present invention can be more fully understood with reference to FIGS. 1–6, in which like reference numerals designate like items. FIG. 1 is an electrical block diagram of an exemplary portable electronic device 100 in accordance with the present invention. The portable electronic device 100 includes, inter alia, a housing 101, a lost device detection circuit 102, a proximity detector 103, an external capacitance sensor 105, an alerting device 107, and a direct current (DC) power source 109. The device 100 may further include other conventional components, such as a user interface 111 and a display 113. In the event the portable device 100 is a wireless communication device, such as a cellular phone, pager, PDA, instant messenger, wireless email device, or two-way radio, the device 100 may further include an antenna 115, a transmitter 117 (when two-way operation is desired), and a receiver 119.

All the components of the portable device 100 are wholly or partially contained within the housing 101. The housing 101 may be fabricated in any conventional manner (e.g., as molded plastic) and implemented in a relatively straight arrangement (often referred to as a "candy bar" arrangement) or in a collapsible arrangement in which two or more housing members are mechanically coupled together through use of a hinge (e.g., in a flip phone implementation), bearings, a cam and/or a cam follower (e.g., in a twist or rotational phone implementation), or any other conventional means that allows the housing members to move relative to each other. In the collapsible arrangement, some of the device components may reside in each housing member.

When included, the antenna 115, the transmitter 117 and the receiver 119 are well-known components of conventional wireless communication devices. The antenna 115 may be any conventional antenna designed and configured to facilitate radio transmissions at the radio or microwave frequencies used in the applicable communication system. The transmitter 117 and the receiver 119 enable the portable communication device 100 to communicate information (voice and/or data) to and acquire information from a base transceiver (e.g., base site, cell site, wireless local area network access point, or cordless phone base unit) or another wireless communication device. In this regard, the transmitter 117 and the receiver 119 include appropriate, conventional circuitry to enable digital or analog transmissions over a wireless communication channel 127. Although not shown in FIG. 1, the communication device 100 may optionally include an antenna switch, duplexer, circulator or other means of isolating the receiver 119 from the transmitter 117 in accordance with known techniques.

The implementations of the transmitter 117 and the receiver 119 depend on the implementation of the wireless device 100. For example, the transmitter 117 and the receiver 119 may be implemented as an appropriate wireless modem, or as conventional transmitting and receiving components of two-way wireless devices. In the event that the transmitter 117 and the receiver 119 are implemented as a wireless modem, the modem may be internal to the portable wireless device 100 or insertable into the wireless device 100 (e.g., embodied in a commercially available wireless radio frequency (RF) modem implemented on a wireless transceiver card that complies with the Personal Computer Memory Card International Association (PCMCIA) standard). For a wireless telephone, pager or two-way radio, the transmitter 117 and the receiver 119 are preferably implemented as part of the wireless device hardware and software architecture in accordance with known techniques. One of ordinary skill in the art will recognize that most, if not all, of the functions of the transmitter 117 and/or the receiver 119 may be implemented in a processor, such as processor 121 forming part of the lost device detection circuitry 102. However, the processor 121, the transmitter 117, and the receiver 119 have been artificially partitioned herein to facilitate a better understanding of the present invention.

The proximity detector 103 preferably comprises a magnetic switch, such as a conventional silicon Hall effect sensor that is commercially available from various manufacturers (e.g., Allegro Microsystems of Worchester, Mass., U.S.A., Infineon Technologies AG of Munchen, Germany, or Quantum Research Group Ltd. of Pittsburgh, Pa., U.S.A.). Alternatively, the proximity detector 103 may be an electromechanical switch, an optical switch, an infrared detector, or any other conventional proximity sensing device or system. The proximity detector 103 is arranged to enable it to sense the presence or absence of an applicable energy source located in or on a retaining device (not shown in FIG. 1, but shown in an exemplary manner in FIGS. 2–4) used to maintain the portable electronic device 100 in close proximity to the person or personal property of the device's user. For example, when the proximity detector 103 is a magnetic switch, the proximity detector 103 is arranged to sense the intensity level of a magnetic field emanating from the electronic device's retaining device.

The lost device detection circuit 102 preferably includes a processor 121 and a memory 123, which processor 121 and memory 123 may form part of the central processor and memory used by the portable electronic device 100 to perform many of the device's conventional functions. The processor 121 preferably includes one or more microprocessors, microcontrollers, digital signal processors (DSPs), state machines, logic circuitry, or any other device or devices that process information based on operational or programming instructions. Such operational or programming instructions are preferably stored in the memory 123, which memory 123 may be an integrated circuit (IC) memory chip containing any form of random access memory (RAM) or read only memory (ROM), a floppy disk, a compact disk read only memory (CD-ROM), a digital versatile disk (DVD), a flash memory card or any other medium for storing digital information. One of ordinary skill in the art will recognize that when the processor 121 has one or more of its functions performed by a state machine or logic circuitry, the memory 123 containing the corresponding operational instructions may be embedded within the state machine or logic circuitry. The operations performed by the processor 121 and the rest of the electronic device components are described in detail below. Alternatively, the lost device detection circuit 102 may be implemented solely in hardware, using conventional digital logic components, or partially in hardware and partially in software executed by the processor 121.

The external capacitance sensor 105 provides an input to the lost device detection circuit 102 enabling the lost device detection circuit 102 to determine whether the portable device 100 was removed from the retaining device intentionally or unintentionally by the electronic device's user. In a preferred embodiment, the external capacitance sensor 105 includes a relatively large, thin metallic substrate 125 located proximate (e.g., just under, on or forming part of) an external surface of the housing 101. The metallic substrate 125 may simultaneously be used to form the device's antenna 115 (when used) or serve a mechanical device function (e.g., form an enclosure for the device's display 113 or user interface 111). The external capacitance sensor 105 is arranged to detect an increase in capacitance originating from the external surface of the device housing 101 (e.g., due to the presence of a human hand thereon). A preferred embodiment of the external capacitance sensor 105 is described in more detail below with respect to FIG. 5.

The alerting device 107 comprises a conventional audio alerting mechanism, such as an audio transducer, or a tactile alerting mechanism, such as a vibrator. The DC power source 109 preferably comprises a single battery or an arrangement of batteries, although other DC power sources, such as fuel cells may be utilized. The DC power source 109 supplies DC power for use by all the electrical components of the portable device 100. The display 113, when utilized, preferably comprises a liquid crystal display (LCD), an electronic ink display, a light emitting diode (LED) display, an organic LED (OLED) display, a liquid plasma display, or any other conventional electronic display. The display 113 may be implemented as a single display or as a combination of displays.

The user interface 111 may be any conventional user interface mechanism, including without limitation, a keypad, a touchscreen, a keyboard, a joystick, a rollerball, a thumbwheel, a set of scroll buttons, a graphical user interface (GUI), a mouse, or any combination of the foregoing devices. In the event that the portable electronic device 100 supports voice-activated operation or is a two-way wireless voice-capable device, the user interface 111 may include a microphone(s) or other acoustic receptor(s) to facilitate such operation.

Figure 2:
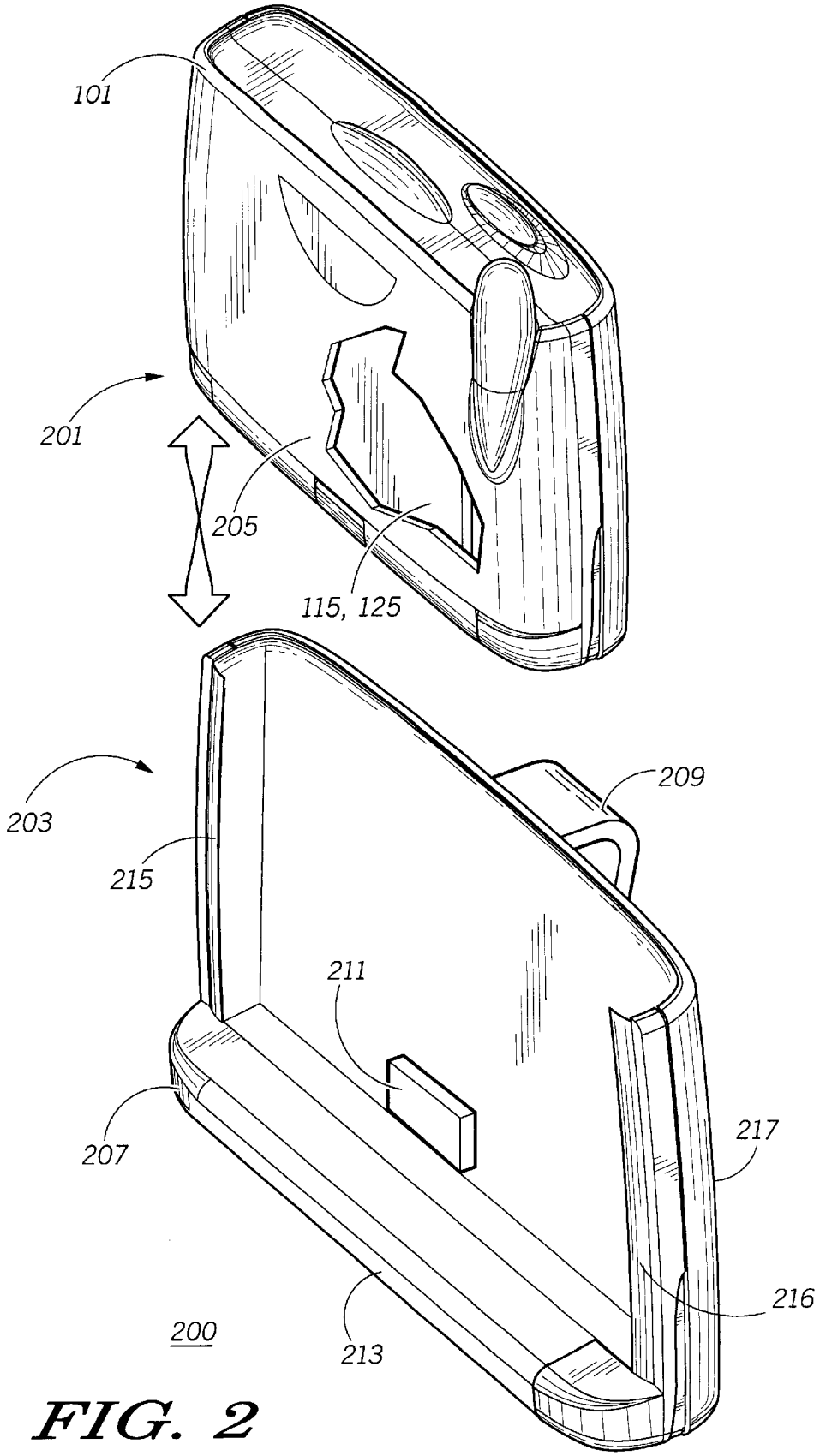
FIG. 2 is an isometric, partial cut-away view of an exemplary loss detection system including a portable electronic device and its associated retaining device in accordance with one embodiment of the present invention.

FIG. 2 is an isometric, partial cut-away view of an exemplary loss detection system 200 including a portable electronic device 100 and its associated retaining device 203 in accordance with one embodiment of the present invention. The portable electronic device 100 in this embodiment is a wireless communication device 201, such as a pager (a two-way pager is depicted in FIG. 2), a cellular phone, a PDA, an instant messaging device, a two-way radio, or any other wireless communication device. The wireless device 201 preferably includes, inter alia, a housing 101 and all the other portable device components 102–123 described above with respect to FIG. 1. In this embodiment, the wireless device antenna 115 (or other metallic substrate 125 used to allow the portable device 201 to determine whether it was intentionally removed from the retaining device 203) is located directly under or otherwise proximate to an external surface 205 of the device housing 101 in an area of the device 201 that is most likely to be grasped by the device user when the user intentionally removes the device 201 from the retaining device 203. Thus, as discussed in more detail below with respect to FIG. 5, the wireless device antenna 115 or other metallic substrate 125, when so arranged, forms part of an external capacitance sensor 105 that detects changes in capacitance originating from the external surface 205 of the housing 101, thereby allowing the portable device's lost device detection circuit 102 to determine whether removal of the device 201 from the retaining device 203 was intentional.

In addition to a portable electronic device 100 (in this embodiment, a wireless communication device 201), the loss detection system 200 includes the portable device's retaining device 203. The retaining device 203, depicted in this embodiment as a holster, includes a support mechanism 207, such as a plastic support platform 213 and side and rear retaining walls 215–217, a fastening mechanism 209 (e.g., a plastic clip or clamp), and means 211 for enabling the portable device 100, 201 to determine whether it has been removed from the retaining device 203. In the preferred embodiment, the aforementioned means 211 is a small magnet embedded in or placed on (e.g., with an adhesive) the support mechanism 207 at a location that is proximate to the portable device's proximity detector 103 when the portable device 100, 201 is placed in the retaining device 203. In an alternative embodiment, the magnet may be replaced with an LED, a battery and conventional circuitry for use with an optical or infrared proximity detector 103, or an appropriately placed housing extrusion that activates or de-activates an electromechanical switch proximity detector 103 when being placed in and removed from the retaining device 203. If an electromechanical switch proximity detector 103 is used, the retaining device housing extrusion may be simply integrated into the support mechanism 205 of the retaining device 203 using conventional techniques. Those of ordinary skill in the art will appreciate that the retaining device 203 of the loss detection system 200 may include various other devices or components that work in concert with the selected portable device proximity detector 103 to enable the portable device 100, 201 to determine whether it has been removed from the retaining device 203, and thereby facilitate a determination of whether the portable device 100, 201 was removed from the retaining device 203 inadvertently.

Figure 3:
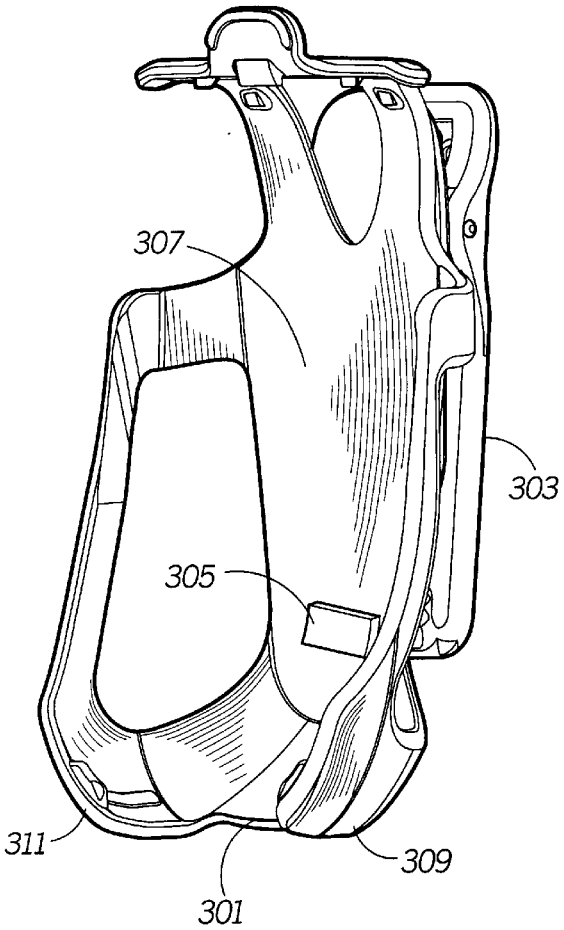
FIG. 3 is an isometric view of a retaining device in accordance with a first alternative embodiment of the present invention.
Figure 4:
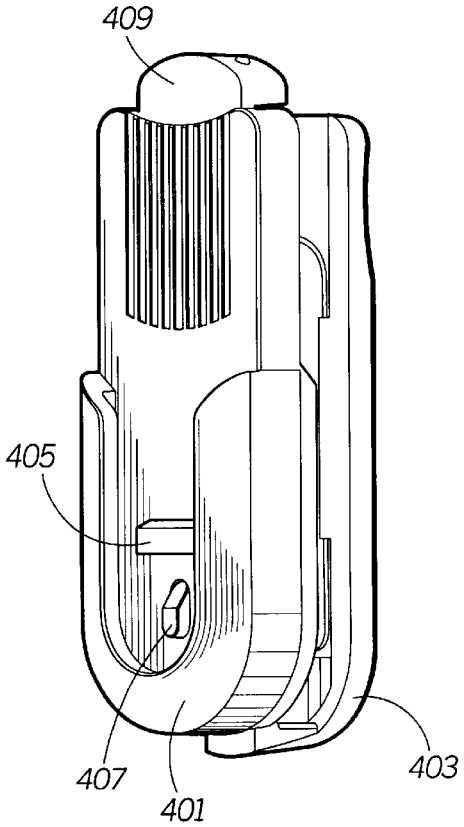
FIG. 4 is an isometric view of a retaining device in accordance with a second alternative embodiment of the present invention.

The fastening mechanism 209 comprises any conventional fastening device, such as an integrally molded friction-fit clamp as depicted in FIG. 2 or a spring-loaded clip as depicted in FIGS. 3 and 4. The fastening mechanism 209 enables the system user to attach the retaining device 203 (and the portable device 100, 201 when it is in the retaining device 203) to the personal effects or property (e.g., belt, purse, bag, pocket and so forth) of the user. The fastening mechanism 209 and the support mechanism 207 may form an integrated device, such as depicted in FIG. 2, or may be separate components connected together using pins, press fit mechanisms, or other conventional mechanical fasteners.

FIG. 3 is an isometric view of a retaining device 300 in accordance with a first alternative embodiment of the present invention. Similar to its counterpart depicted in FIG. 2, the retaining device 300 includes a support mechanism 301, a fastening mechanism 303 and a component, circuit or other means 305 for enabling the portable electronic device 100 to determine whether it has been removed from the support mechanism 301. The support mechanism 301 in this embodiment includes a rear support wall 307 and two extending support arms 309, 311. The fastening mechanism 303 in this embodiment is a spring-loaded clip. This embodiment of the retaining device 300 may be used to retain a flip or clamshell cellular phone, such as the i90c cellular phone that is commercially available from Motorola, Inc. of Schaumburg, Ill., U.S.A.

FIG. 4 is an isometric view of a retaining device 400 in accordance with a second alternative embodiment of the present invention. Similar to its counterparts depicted in FIGS. 2 and 3, the retaining device 400 includes a support mechanism 401, a fastening mechanism 403 and a component, circuit or other means 405 for enabling the portable electronic device 100 to determine whether it has been removed from the support mechanism 401. The support mechanism 401 in this embodiment includes a support cup and a press-release pin 407, the press-release pin 407 recessing and releasing upon depression of an accompanying button 409. The fastening mechanism 403 in this embodiment, similar to the embodiment discussed above with respect to FIG. 3, is a spring-loaded clip. This embodiment of the retaining device 400 may be used to retain a cellular phone or other portable device having an embedded or attachable receptacle for the press-release pin 407, such as the i85s cellular phone that is commercially available from Motorola, Inc. of Schaumburg, Ill., U.S.A.

Although not depicted, various other retaining devices may be employed for use in the loss detection system 200. For example, the retaining device may be a carrying case or a combination of a carrying case and a belt clip or a holster. The actual implementation of the retaining device is up to the designer so long as the retaining device includes a support mechanism, a fastening mechanism and an appropriate component, circuit or other means that functions in cooperation with the portable device's proximity detector 103 to enable the portable device 100 to determine whether it has been removed from the retaining device.

Figure 5:
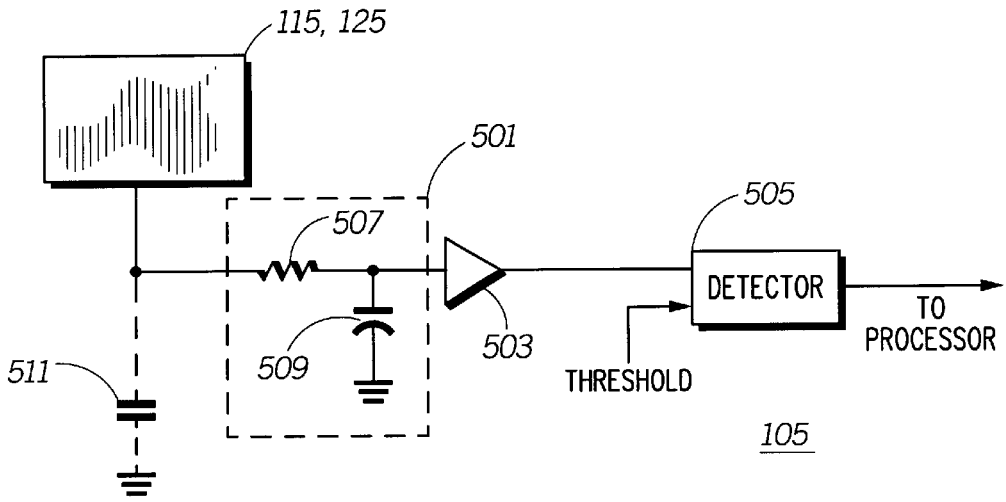
FIG. 5 is an electrical circuit diagram of an external capacitance sensor in accordance with a preferred embodiment of the present invention.

FIG. 5 is an electrical circuit diagram of an external capacitance sensor 105 in accordance with a preferred embodiment of the present invention. The preferred external capacitance sensor 105 includes a metallic substrate 125 (e.g., a wireless device antenna 115), a lowpass filter 501, an amplifier 503 and a detector 505 coupled together in series. The metallic substrate 125 is preferably sufficiently large to enable an increase in capacitance 511 to be detected when a human hand grasps the housing 101 of the portable device 100. In a preferred embodiment, the metallic substrate 125 comprises a copper substrate having a surface area of at least one hundred (100) square millimeters ($mm^2$). The lowpass filter 501 is preferably implemented using a resistor 507 and a shunt capacitor 509 (RC circuit configuration) to provide a cutoff frequency of approximately ten Hertz or less. The lowpass filter 501 may be alternatively implemented as a conventional LC circuit in environments in which a purely reactive circuit does not cause performance degradation of the portable device 100, or as a conventional RLC circuit. When the external capacitance sensor 105 is used in a wireless communication device and includes the device's antenna 115, the lowpass filter 501 is preferably implemented as an RLC circuit by inserting an inductor (not shown) in series with the resistor 507, wherein the lowpass filter 501 together with the amplifier 503 present a high impedance (e.g., at least ten times the input impedance of the antenna 115) over the operating frequency range of the antenna 115.

The amplifier 503 preferably comprises a conventional high gain, operational amplifier, such as a model AD825 operational amplifier that is commercially available from Analog Devices, Inc. of Norwood, Mass., U.S.A. or any similarly performing operational amplifier, that provides a high input impedance and a low output impedance in accordance with conventional techniques. The detector 505 preferably comprises a comparator that compares the output of the operational amplifier 503 with a threshold and produces an output signal based upon the comparison (e.g., a logic 1 if the operational amplifier output signal level exceeds the threshold indicating an increase in applied capacitance in the 10 Hz or less frequency range or a logic 0 otherwise). The output signal of the detector 505 is applied to the processor 121 or logic hardware of the lost device detection circuit 102 for use in determining whether removal of the portable device 100 from its retaining device 203 was intentional.

Referring now to FIGS. 1, 2, and 5, operation of the portable electronic device 100 and the loss detection system 200 occurs substantially as follows in accordance with a preferred embodiment of the present invention. During normal use of the portable device 100, the device user uses the retaining device's fastening mechanism (e.g., 209) to attach the retaining device (e.g., 203) to the user's personal property, powers on the portable device 100, and places the portable device 100 in the support mechanism 207 of the retaining device 203. While the portable device 100 is powered on and at rest in the retaining device 203, the proximity detector 103 senses that the portable device 100 is in the retaining device 203 (e.g., by sensing the presence of a sufficiently strong magnetic field emanating from a magnet 211 forming part of the retaining device 203) and provides an appropriate signal (e.g., logic 0) to the device processor 121 indicating that the portable device 100 is in its retaining device 203.

The external capacitance sensor 105 also provides an input to the processor 121. When the portable device 100 is at rest in the retaining device 203, the input supplied by the external capacitance sensor's detector 505 (e.g., a logic 0) is sufficient to inform the processor 121 that a low frequency increase in capacitance indicative of the presence of a human hand moving toward and then onto the portable device 100 has not been detected. The processor 121, executing programming instructions stored in the memory 123, effectively computes a logical AND using the output of the proximity detector 103 and the output of the external capacitance sensor 105 to determine the possessive state of the portable device 100.

In the event that the portable device 100 is intentionally removed from the retaining device 203, the movement of the user's hand near and then onto the external surface of the housing 101 of the portable device 100 creates a low frequency (e.g., one or two Hertz) increase in capacitance 511 between the metallic substrate 125 proximate the housing's external surface and ground. The low frequency capacitance increase creates a low frequency signal output from the metallic substrate 125. The low frequency signal is passed to the amplifier 503 by the lowpass filter 501. The lowpass filter 501 serves to remove non-proximity signals, such as hum, noise, electromagnetic interference, and so forth. The amplifier 503 amplifies the signal and applies it to the detector 505. The detector 505 compares the output signal level of the amplifier 503 to a threshold level that has been empirically determined to correspond to the minimum level of the amplifier output when a human hand removes the portable device 100 from its retaining device 203. The threshold level may be established using any conventional method, such as through use of a Zener diode voltage divider circuit (temperature compensated if necessary). Since, in this scenario, the portable device 100 is being intentionally removed, the output of the amplifier 503 exceeds the threshold and the detector 505 outputs a logic signal indicative of the presence of a human hand on the portable device 100 (e.g., a logic 1). The output of the detector 505 is provided to the processor 121.

In the event that the portable device 100 is removed from the retaining device 203 inadvertently, no increase in capacitance 511 is detected by the detector 505 of the external capacitance sensor 105. Consequently, the output signal supplied by the detector 505 to the processor 121 (e.g., a logic 0) indicates that a human hand has not been placed upon the portable device 100.

When the portable device 100 is removed from its retaining device 203, whether intentionally or inadvertently, the proximity detector 103 detects the removal and generates a signal indicative of the removal (e.g., a logic 1). In the preferred embodiment, the proximity detector 103 senses the level of a magnetic field produced by a magnet forming part of the retaining device 203. As the portable device 100 is removed from the retaining device 203, the magnetic field intensity will decrease slowly and such decrease in intensity will be detected by the proximity detector 103. Once the magnetic field intensity decreases below a preset threshold, the proximity detector 103 (e.g., a Hall effect switch) will change its state and output to indicate that the portable device 100 has been removed from the retaining device 203. The output of the proximity detector 103 is also provided to the processor 121.

The processor 121 receives the output signals from the proximity detector 103 and the external capacitance sensor 105 and uses them to determine whether removal of the portable device 100 from its retaining device 203 was intentional or inadvertent. The processor 121 preferably performs a logical AND function on the outputs of the proximity detector 103 and the external capacitance sensor 105 to determine whether the removal was intentional or not. When the output of the proximity detector 103 (e.g., logic 1) indicates that the portable device has been removed from the retaining device 203 and the output of the external capacitance sensor 105 (e.g., logic 1) indicates that a human hand was placed upon the portable device housing 101 contemporaneous with the removal, the processor 121 determines that the removal was intentional and no alert is provided. On the other hand, when the output of the proximity detector 103 (e.g., logic 1) indicates that the portable device 100 has been removed from the retaining device 203 and the output of the external capacitance sensor 105 (e.g., logic 0) indicates that a human hand was not placed upon the portable device housing 101 contemporaneous with the removal, the processor 121 determines that the removal was unintentional and proceeds to promptly alert the device user of the dropped or misplaced portable device 100. As an alternative, or in addition, to the processor 121, the lost device detection circuit 102 may employ conventional logic hardware to perform the AND function on the outputs of the proximity detector 103 and the external capacitance sensor 105, and to control wholly or partially the alerting of the portable device user in the event of an inadvertent removal of the device 100. The inadvertent removal detection process resets upon re-insertion of the portable device 100 into its retaining device 203.

In order to promptly alert the portable device user of an inadvertent removal of the device 100 from its retaining device 203, the processor 121 preferably instructs the alerting device 107 to sound or emanate a loud audible alert. The audible alert is intended to direct the user's immediate attention to the inadvertent removal, thereby increasing the likelihood that the user will retrieve the dropped or misplaced device 100 promptly, before it gets damaged or taken by someone else. Alternatively or additionally, if the portable device 100 is a wireless communication device (e.g., device 201), the processor 121 may retrieve a predetermined message (e.g., canned or otherwise previously stored voice or data message) from memory 123 and instruct the transmitter 117 to transmit the stored message over a wireless channel 127 to a user-identified target device, such as the user's home telephone or another wireless device typically carried by the user (e.g., cellular phone, pager, or PDA), using an appropriate transmission protocol for the system in which the wireless device 201 operates. In this alternative or additional embodiment, an identification (e.g., phone number, pager number, email address or so forth) of the target device is preferably entered into the wireless device 201 and stored in memory 123 prior to an inadvertent removal of the wireless device 201 from its retaining device 203.

As discussed above, the present invention provides a loss detection system for reducing the likelihood of losing a portable electronic device that has been inadvertently removed from its retaining device. The loss detection system includes a portable device and a retaining device that work together to enable the portable device to quickly alert its user in the event that the portable device is unintentionally or inadvertently removed form the retaining device, thereby increasing the likelihood that the lost portable device will be retrieved promptly and undamaged by its user.

Figure 6:
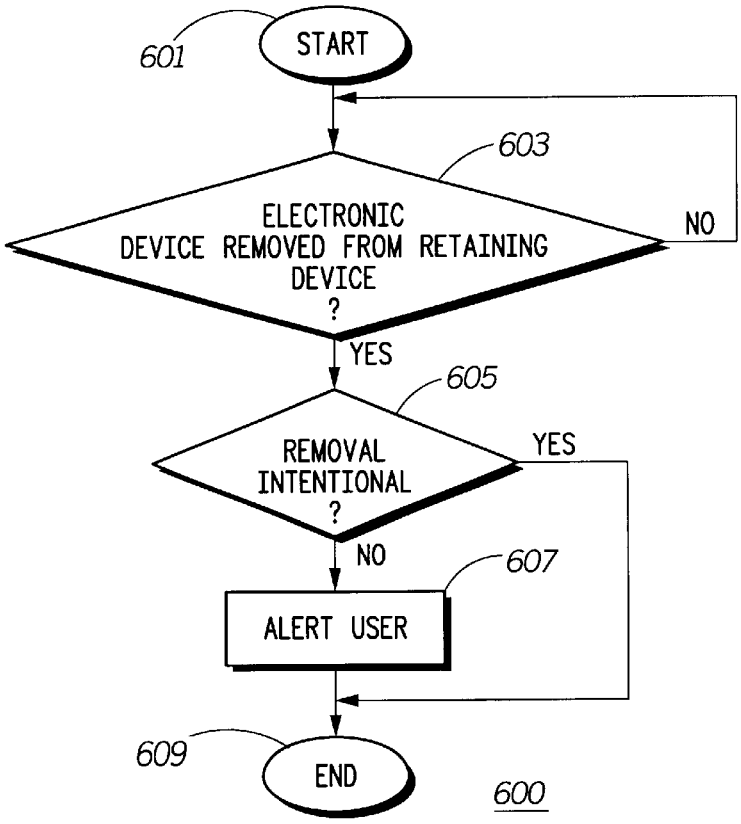
FIG. 6 is a logic flow diagram of steps executed by a portable electronic device to alert a user thereof in the event that the device is inadvertently removed from its retaining device in accordance with the present invention.

FIG. 6 is a logic flow diagram 600 of steps executed by a portable electronic device to alert a user thereof in the event that the device is inadvertently removed from its retaining device in accordance with the present invention. The logic flow begins (601) when the portable device determines (603) whether it has been removed from its retaining device after previously having been placed in its retaining device. In a preferred embodiment, such a determination is made through use of a proximity detector in the portable device to detect the presence or absence of a magnetic field generated by a magnet embedded in or attached to the retaining device. The output of the proximity detector is preferably a logic 1 or logic 0 corresponding to the applicable condition of the portable device in or out of the retaining device and is supplied to the portable device's processor. For example, when the portable device is in the retaining device, the magnetic field emanating from the retaining device's magnet is sensed by the proximity detector (e.g., Hall effect sensor), and the output of the proximity detector (e.g., logic 0) is such that the portable device processor determines that the portable device is in the retaining device. When the portable device is out of the retaining device, the magnetic field emanating from the retaining device's magnet is not sensed by the proximity detector, and the output of the proximity detector (e.g., logic 1) is such that the portable device processor determines that the portable device is not in the retaining device.

While the foregoing discussion with respect to block 603 focused on the use of a magnet and a magnetic field detector to determine whether the portable device has been removed from the retaining device, one of ordinary skill in the art will appreciate that other combinations may be used to enable the portable device to determine whether or not it is currently in its retaining device. For example, an electromechanical switch may be included in the portable device to form the proximity detector. In this case, the retaining device would be implemented to mechanically change the position of the switch depending on whether or not the portable device was in or out of its retaining device. Alternatively, the retaining device may include a simple, low power LED circuit and battery, and the portable device may include an optical or infrared sensor to detect the presence or absence of the portable device from the retaining device. Various other proximity detectors and means implemented on or in the retaining device to enable the portable device to determine whether or not it is in its retaining device may be implemented using conventional materials and components, and all such alternatives are intended to be within the spirit and scope of the appended claims.

In the event that the portable device determines (603) that it has been removed from its retaining device, the portable device also determines (605) whether the removal was intentional. This determination is preferably made by detecting whether the portable device was removed from the retaining device by a human hand. As discussed in detail above with respect to FIGS. 1–5, the portable device preferably determines whether an increase in capacitance between the portable device and ground was detected just prior to or contemporaneous with detecting the removal of the portable device from its retaining device. The increase in capacitance may be between an antenna of the portable device and ground (e.g., where the portable device is a wireless communication device having an embedded antenna) or between any other external surface of the portable device housing and ground. Detection of such an increase in capacitance would cause the portable device to assume that the portable device was removed by a human hand and, therefore, was removed intentionally.

Instead of or together with determining an increase in capacitance, the portable device might use other methods or approaches to determine whether the removal of the portable device was intentional. For example, the portable device may be equipped with an accelerometer to determine the speed at which the portable device was removed from the retaining device, with a slower speed indicating intentional removal and a higher speed indicating inadvertent removal. Various other detection methods may alternatively be used as will be apparent to those of ordinary skill in the art.

In the event that the removal of the portable device from its retaining device is determined by the portable device to be unintentional, the portable device alerts (607) the portable device user and the logic flow ends (609). On the other hand, if the removal is determined to be intentional, no alert is provided and the logic flow ends (609). In a preferred embodiment, the portable device sounds an audible alert upon detecting an unintentional removal of the portable device to rapidly inform the user that the portable device fell out of or off of the retaining device. Alternatively, various other forms of alert may be provided. For example, when the portable device is a wireless communication device capable of sending previously stored data or voice messages, the portable device may automatically transmit such a predetermined message to a target device that is accessible by the portable device user, such as a cellular phone, wireline phone, pager, PDA, computer (e.g., via email), or other communication device, to inform the user that he or she has lost the portable device. As another example, LEDs in the portable device may be displayed at full brightness to illuminate the portable device as much as possible in an attempt to draw the attention of the user. Those of ordinary skill in the art will readily appreciate that various other methods for alerting the user promptly upon detecting the unintentional removal of the user's portable device from its retaining device may be employed using conventional techniques. All such alerting methods and procedures are intended to be within the spirit and scope of the appended claims.

The present invention encompasses a method and apparatus for reducing the likelihood of losing a portable electronic device that has been inadvertently removed from its retaining device. With this invention, the portable device user is alerted promptly (preferably immediately) after the portable device detects that it has been unintentionally or inadvertently removed from its retaining device. By quickly and automatically alerting the user of the unintentionally removed portable device, the present invention increases the user's chances of recovering the device before it gets damaged (e.g., trampled, kicked, etc.), further misplaced, or taken by someone else.

In the foregoing specification, the present invention has been described with reference to specific embodiments. However, one of ordinary skill in the art will appreciate that various modifications and changes may be made without departing from the spirit and scope of the present invention as set forth in the appended claims. Accordingly, the specification and drawings are to be regarded in an illustrative rather than a restrictive sense, and all such modifications are intended to be included within the scope of the present invention.

Benefits, other advantages, and solutions to problems have been described above with regard to specific embodiments of the present invention. However, the benefits, advantages, solutions to problems, and any element(s) that may cause or result in such benefits, advantages, or solutions, or cause such benefits, advantages, or solutions to become more pronounced are not to be construed as a critical, required, or essential feature or element of any or all the claims. As used herein and in the appended claims, the term "comprises," "comprising," or any other variation thereof is intended to refer to a non-exclusive inclusion, such that a process, method, article of manufacture, or apparatus that comprises a list of elements does not include only those elements in the list, but may include other elements not expressly listed or inherent to such process, method, article of manufacture, or apparatus.

What is claimed is:

1. A method for reducing the likelihood of losing a portable electronic device, the method comprising the steps of:

determining that the portable electronic device has been removed from a retaining device;

determining whether the portable electronic device was removed by a human hand; and alerting the user in the event that the portable electronic device was not removed by a human hand.

2. The method of claim 1, wherein the portable electronic device is a wireless communication device and wherein the step of determining whether the portable electronic device was removed by a human hand comprises the step of:

detecting an increase in capacitance between an antenna of the wireless communication device and ground.

3. The method of claim 1, wherein the step of determining whether the portable electronic device was removed by a human hand comprises the step of:

detecting an increase in capacitance between an external surface of a housing of the portable electronic device and ground.

4. The method of claim 1, wherein the step of alerting the user comprises the step of:

sounding an audible alert.

5. The method of claim 1, wherein the step of alerting the user comprises the step of:

automatically transmitting a predetermined message to a target device that is accessible by the user.

6. The method of claim 1, wherein the step of determining that the portable electronic device has been removed from the retaining device comprises the step of:

detecting a reduction in intensity of a magnetic field between the portable electronic device and the retaining device.

7. A portable electronic device comprising:

a proximity detector that detects removal of the portable electronic device from a retaining device;

a housing having an external surface;

an external capacitance sensor arranged to detect a change in capacitance originating from the external surface of the housing; and a lost device detection circuit operably coupled to the external capacitance sensor and the proximity detector, the lost device detection circuit determining whether removal of the portable electronic device from the retaining device was intentional based at least on an output of the external capacitance sensor.

8. The portable electronic device of claim 7, further comprising:

an alert responsive to the lost device detection circuit and operable to inform a user that the portable electronic device has been removed from the retaining device in the event said removal was determined to be unintentional.

9. The portable electronic device of claim 7, wherein the portable electronic device is a wireless communication device, the portable electronic device further comprising:

a transmitter responsive to the lost device detection circuit and operable to transmit a predetermined message to a target device that is accessible by a user of the wireless communication device in the event that removal of the portable electronic device was determined to be unintentional.

10. The of portable electronic claim 7, wherein the proximity detector comprises a magnetic field sensor.

11. The portable electronic device of claim 7, wherein the portable electronic device is a wireless communication device, wherein the external capacitance sensor comprises at least an antenna, a lowpass filter and an amplifier operably coupled together in series, wherein the lowpass filter and the amplifier together present a high impedance at an operating frequency of the antenna, and wherein at least part of the antenna is positioned proximate the external surface of the housing.

12. The portable electronic device claim 7, wherein the external capacitance sensor comprises at least a metallic substrate, a lowpass filter, and an amplifier operably coupled together in series, and wherein the metallic substrate is positioned proximate the external surface of the housing.

13. The portable electronic of claim 7, wherein the lost device detection circuit comprises a processor and a memory coupled to the processor, wherein the memory includes operating instructions that, when executed by the processor, cause the processor to at least determine whether removal of the portable electronic device from the retaining device was intentional based at least oil the output of the external capacitance sensor.

14. A loss prevention system comprising:

a wireless communication device that includes:

a proximity detector that detects the removal of the wireless communication device from a retaining device;

a housing having an external surface;

an external capacitance sensor arranged to detect a change in capacitance originating from the external surface of the housing; and a lost device detection circuit operably coupled to the external capacitance sensor and the proximity detector, the lost device detection circuit determining whether removal of the wireless communication device from the retaining device was intentional based at least on an output of the external capacitance sensor; and a retaining device for retaining the wireless communication device proximate to a user of the wireless communication device, the retaining device including:

a fastening mechanism for attaching the retaining device to personal property of the user;

a support mechanism for retaining the wireless communication device; and means for enabling the proximity detector to determine whether the wireless communication device was removed from the support mechanism.

* * * * *